United States Patent [19]

Gittings

[11] 4,065,173

[45] Dec. 27, 1977

[54] FOLDING CHAIR

[75] Inventor: Robert S. Gittings, Tiburon, Calif.

[73] Assignee: Gold Medal, Inc., Racine, Wis.

[21] Appl. No.: 626,284

[22] Filed: Oct. 28, 1975

[51] Int. Cl.[2] ..... A47C 4/28

[52] U.S. Cl. ..... 297/45; 297/48; 16/169

[58] Field of Search ..... 297/16, 42, 45, 46, 297/47, 48; 16/159, 168, 169

[56] References Cited

U.S. PATENT DOCUMENTS

| | | | |
|---|---|---|---|
| D. 129,157 | 8/1941 | Burst | 297/45 X |
| 715,346 | 12/1902 | Brubaker | 297/33 |
| 794,063 | 7/1905 | West | 16/159 X |
| 1,905,830 | 4/1933 | Ericson | 297/45 |
| 2,095,411 | 10/1937 | Everest et al. | 297/45 |
| 2,601,379 | 6/1952 | Everest et al. | 297/45 X |
| 2,620,859 | 12/1952 | Kundtz et al. | 297/45 |
| 2,930,429 | 3/1960 | Mize | 297/45 |
| 3,851,914 | 12/1974 | Nii | 297/45 |

FOREIGN PATENT DOCUMENTS

| | | | |
|---|---|---|---|
| 562,576 | 12/1957 | Belgium | 297/45 |
| 689,696 | 9/1930 | France | 297/45 |
| 444,920 | 3/1936 | United Kingdom | 297/45 |

*Primary Examiner*—Roy D. Frazier
*Assistant Examiner*—Peter A. Aschenbrenner
*Attorney, Agent, or Firm*—James E. Nilles

[57] ABSTRACT

A folding chair having two upright sides which can be moved from a spaced apart operative position to a folded position where they are adjacent to one another, the chair also having cross frames between said vertical sides and which can be folded in scissors fashion between chair operative and stored positions. The lower ends of the cross frames are securely anchored in a lower member of the side frames and these lower members are pivotally mounted to the remainder of their side frames. This construction permits the cross frames to pivot with a scissors action and oscillate with the lower member of the side frames, resulting in a sturdy chair with a minimum number of parts for the function obtained.

16 Claims, 7 Drawing Figures

FOLDING CHAIR

BACKGROUND OF THE INVENTION

Folding chairs of the general type to which the present invention pertains have heretofore used cross frame or scissor members between the side frames, but these cross members have been pivoted to the upright members of the side frames for relative movement thereto and this construction resulted in numerous parts, joints, and not a particularly compact chair, especially when in the folded or stored position.

SUMMARY OF THE INVENTION

The present invention provides a folding chair having two vertically arranged side frames and each of which having lower floor engaging or supporting members which are pivotally mounted relative to the remainder of the side frame. A pair of intermediate frames of the scissors type are located between the side frames and have their lowermost ends rigidly anchored in and secured to the lowermost horizontal member of the vertical frame. The upper ends of the intermediate cross frames are secured together by seat rails for supporting a flexible seat therebetween. The entire chair can be easily folded from an extended, operative position for seating to a folded or compact storage position. The chair may be swung between said positions simply by moving the generally vertical, parallel side frames toward and away from one another. The lowermost horizontal floor engaging member of each of the side frames is pivotally mounted with respect to the remainder of the side frame and the intermediate cross frames are anchored to that lowermost horizontal member whereby as the vertical side frames are moved toward and away from one another, their lowermost members pivot along with the scissor action of the intermediate, seat supporting frames.

Another aspect of the invention relates to a chair of the above type in which stop members are pivotally mounted between the vertical side frames and the intermediate frames and define the openmost position of the chair, that is to say they define the lowermost position of the seat and act to support the latter in that position.

The result is a foldable chair that is easily open and closed, has a minimum number of parts and joints and is safe and sturdy in operation.

These and other objects and advantages of the present invention will appear hereinafter as this disclosure progresses, reference being had to the accompanying drawings.

DESCRIPTION OF THE INVENTION

Figure 2:
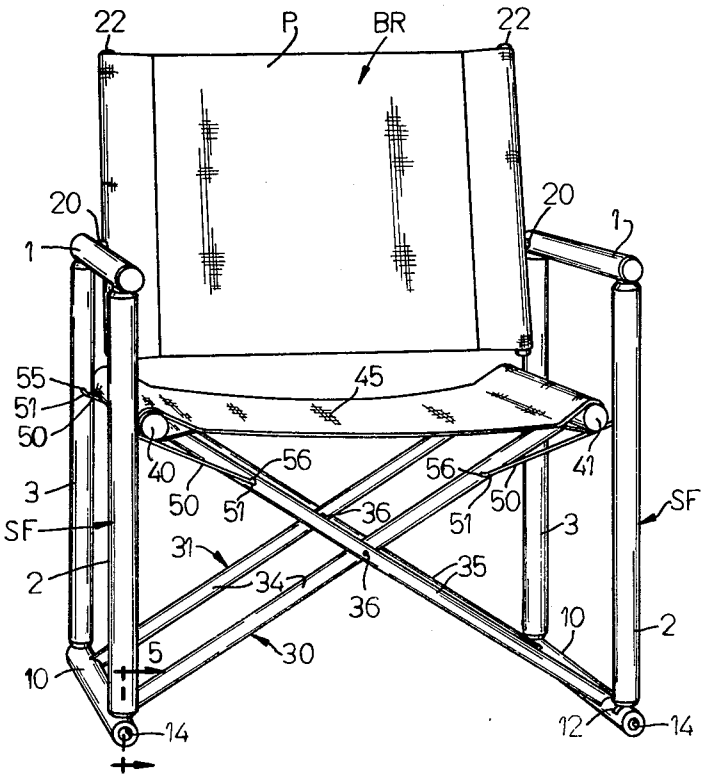
FIG. 2 is another perspective view showing the chair of FIG. 1, the view being taken generally from the front of the chair.

The folding chair provided by the present invention includes two vertical side frames SF each having a generally horizontal arm 1, a front vertical leg 2 and a rear vertical leg 3. The arm and two vertical legs are rigidly secured together by a hole and tongue construction which includes a hole 6 in one of the members and a tongue portion 7 formed on the other members, for example, the vertical legs. The lower member 10 of the side frames is adapted to support the chair on the floor and is arranged in generally horizontal position. In accordance with the invention, a pivoted joint is provided between the lowermost member 10 and the remainder of the side frames. More specifically, the pivotal joint is formed by a screw eye 11 which is screwed into the lower end of each of the vertical legs and extends downwardly therefrom. The eye portion of the screw is inserted in the transverse slots 12 formed in the lower horizontal member. In each end of the lower horizontal member is formed a bore 14 for the reception of a large screw 15 which extends through its respective eye of the screw eye and is anchored by its thread in the interior of the lower member of the side frame. Thus, the lower member is free to oscillate relative to the legs to which it is pivotally attached, the extent of oscillation being determined by the slot 12 formed in the lower member.

A back rest BR is provided between the two side frames and this member can include a pivotal panel P which is pivoted on the pegs 20 extending through the arm members and into the frame members 22 of the back panel.

The back panel may be of the fixed type rather than pivoted, and in that case, a flexible back panel 26 would slip over the rear legs which would then extend upwardly above the arms.

The chair provided by the present invention also includes a pair of intermediate frames 30 and 31 which are transversely positioned and are also spaced in a fore and aft direction. More specifically, the frames 30 and 31, which are identical, each include the cross members 34 and 35 which are pivoted together intermediate their length as at 36. The upper ends of members 34 and 35 of each intermediate frame are rigidly but detachably connected together by screws 38 (FIG. 1), the members 34 and 35 being inserted in corresponding holes 39 in the respective, horizontally disposed seat rails 40 and 41. A flexible seat panel 45 has loops at either of its sides for the reception of the seat rails. By removing screws 38, the rails can be removed and the seat panel replaced.

The lower ends of the cross members of the intermediate frames extend into corresponding bores formed in the lower horizontal member of the side frames and are rigidly secured therein, as by being glued.

Stop means 50 in the form of steel rods are pivotally connected to the vertical legs and to the cross members of the intermediate frames. More specifically, the steel rods have their ends 51 turned at right angles to the main length of the rod and these ends are inserted in corresponding holes 55 in the vertical legs and corresponding holes 56 in the cross members of the intermediate frames.

Figure 1:
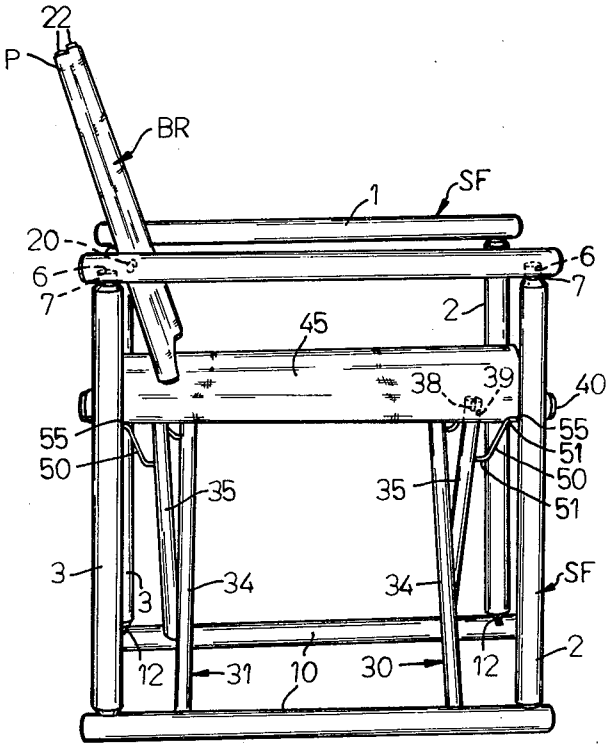
FIG. 1 is a perspective view of a chair made in accordance with the present invention, the view being taken generally from one side thereof.
Figure 4:
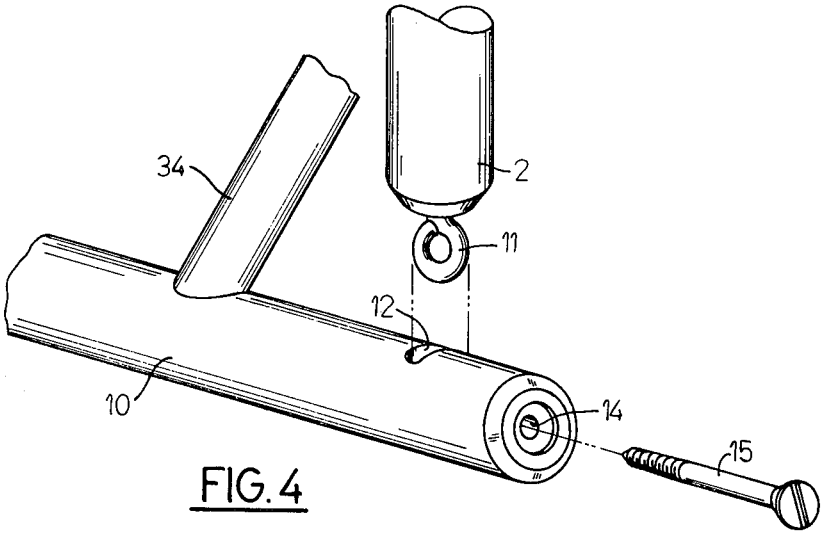
FIG. 4 is an enlarged, fragmentary, perspective, and exploded view of a typical pivotal joint connection between the lower member of the side frames and one of the vertical legs.
Figure 5:
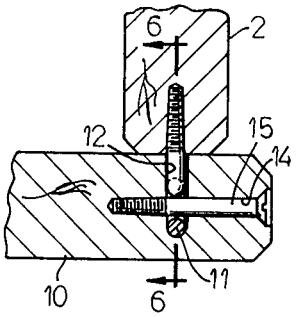
FIG. 5 is a sectional view taken through one of the pivotal joints, such as for example generally along the line 5—5 in FIG. 1.
Figure 6:
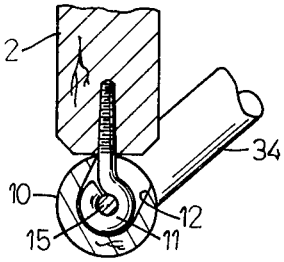
FIG. 6 is a sectional view taken generally along the line 6—6 in FIG. 5, and when the chair is in the normal operative seating position.
Figure 7:
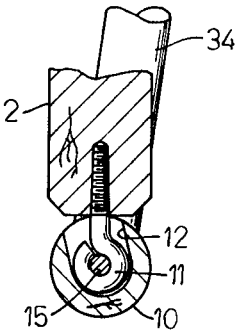
FIG. 7 is a view similar to FIG. 6 but showing the position of the cross frame member with respect to the leg when the chair has been moved to a folded, storage position.
Figure 3:
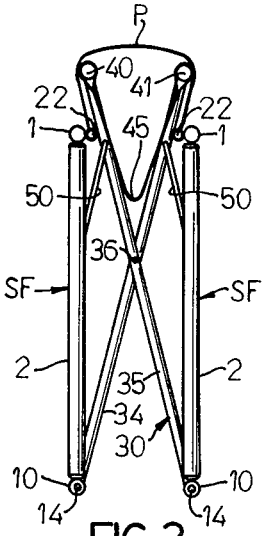
FIG. 3 is a front elevational view of the chair shown in FIGS. 1 and 2, but on a reduced scale, and showing the chair and the back panel has been folded forwardly and the two side frames have been pushed toward one another to a partially closed position.

When the chair is in the operative seating position shown in FIGS. 1 and 2, the side vertical seat frames are spaced a distance apart from one another and the intermediate scissor type frames are extended to a point where the seat rails bear against the stop rods 50. This is the maximum extended position of the chair and the seat rails are thus supported on the stop rods.

When the chair is collapsed to the storage position, the vertical side frames have been moved toward one another so as to lie closely adjacent one another and the cross frames have been collapsed so that their legs are substantially closed. In moving from the operative position to the closed position, it will be noted that the lower, horizontal members 10 of the side frames have rotated about their pivotal connection to the vertical legs together with their respective cross frame members. In other words, the cross frame members and the lowermost member of the side frame rotate or oscillate together as the chair is moved between operative to storage positions.

When in the storage position, the chair assumes a very compact and narrow position.

I claim:

1. A folding chair comprising, a pair of parallel side frames, each side frame comprising, a front leg and rear leg, an arm member rigidly secured between said front and rear legs, and a lower, floor engaging, generally horizontal member, a pivotal connection between said lower member and each of said legs of said side frame, said chair also having a pair of intermediate frames, said intermediate frames each comprising a pair of cross members for opening and closing in scissors fashion, said intermediate frames being spaced apart in a front and rear direction in respect to said chair and having their lower ends rigidly secured to the respective generally horizontal members of said side frames, said cross members each having upper ends, a seat rail for each pair of said upper ends of said cross members which are located at opposite sides of said chair, said rails having holes for the reception of said upper ends of said cross members, and screws between said upper ends of said cross members and rails, whereby said rails are removably but rigidly secured between said upper ends of said cross members, a flexible seat member mounted between said seat rails, said seat member having looped ends slipped over said rails, said side frames being movable toward and away from one another between operative seating and collapsed, storage positions, during which said lower members of said side frames oscillate along with said cross frames and relative to said legs.

2. The chair set forth in claim 1 further characterized in that said pivotal connection between said lower member and each of said legs includes a screw eye and pin-like interengaging means.

3. A folding chair comprising, a pair of vertically disposed and parallel side frames, each side frame comprising, a generally vertical front leg and rear leg, an arm member rigidly secured between said front and rear legs, and a lower, floor engaging, generally horizontal member, a pivotal connection between said lower member and each of said legs of said side frame, said chair also having a pair of intermediate frames, said intermediate frames each comprising a pair of cross members pivotally connected together intermediate their length for opening and closing in scissors fashion, said intermediate frames being spaced apart in a front and rear direction in respect to said chair and having their lower ends rigidly secured to the respective generally horizontal members of said side frames, said cross members each having upper ends, a seat rail for each pair of said upper ends of said cross members which are located at opposite sides of said chair, said rails having holes for the reception of said upper ends of said cross members, and screws between said upper ends of said cross members and rails, whereby said rails are removably but rigidly secured between the upper ends of said cross members, a flexible seat member having looped ends slipped over said seat rails, a back panel secured between said side frames, and stop means between said side frames and said intermediate frames for supporting said seat rails when said chair is in an operative position, said side frames being movable toward and away from one another between operative seating and collapsed storage positions, whereby said lower members of said side frames oscillate along with said cross frames and relative to said legs when said chair is moved between said storage and seating positions.

4. The chair set forth in claim 3 further characterized in that said stop means includes a rod pivotally connected between said legs and said intermediate frames and said seat rails rest on said rods when said seat is in said operative seating position.

5. The chair set forth in claim 3 further characterized in that said pivotal connection between said lower member and each of said legs includes a screw eye and pin-like interengaging means.

6. A folding chair comprising, a pair of generally vertically disposed and parallel side frames, each side frame comprising, a generally vertical front leg and rear leg, an arm member rigidly secured between said front and rear legs, and a lower, floor engaging, generally horizontal member to thereby define a generally rectangular side frame; a pivotal connection between said lower member and each of said legs of said side frame, said chair also having a pair of intermediate frames extending transversely between said side frames, said intermediate frames each comprising a pair of crossed members pivotally connected together intermediate their length for opening and closing in scossors fashion, said cross members each having upper ends, said intermediate frames also being spaced apart in a front and rear direction of said chair and having their lower ends rigidly secured to the respective generally horizontal members of said side frames, a seat rail for each pair of said upper ends of said cross members which are located at opposite sides of said chair, said rails having holes for the reception of said upper ends of said cross members, and screws between said upper ends of said cross members and rails, whereby said rails are removably secured between said upper ends of said cross members, a flexible seat member having a loop along each side for being slipped over said seat rails to form a seat therebetween, a flexible back panel secured between said side frames, and stop means between said side frames and said intermediate frames for supporting said seat rails when said chair is in an operative position, said side frames being movable toward and away from one another between operative seating and collapsed, storage positions, whereby said lower members of said side frames oscillate along with said cross frames and relative to said legs when said chair is moved between said storage and seating positions.

7. The chair set forth in claim 6 further characterized in that said stop means includes a rod pivotally connected between said legs and said intermediate frames and said seat rails rest on said rods when said seat is in said operative seating position.

8. The chair set forth in claim 6 further characterized in that said pivotal connection between said lower member and each of said legs includes a screw eye and pin-like interengaging means.

9. A folding chair comprising, a pair of parallel side frames, each side frame comprising, a front leg and rear leg, an arm member rigidly secured between said front and rear legs, and a lower, floor engaging, generally horizontal member, a pivotal connection between said lower member and each of said legs of said side frame, said pivotal connection including a screw eye engaged in said legs and having an eye portion extending downwardly therefrom, a transverse slot in said lower horizontal member for the reception of said eye portion and a pin-like member extending into said lower member and engaging said eye portion to form a pivot joint between said leg and said lower member, said chair also having a pair of intermediate frames, said intermediate frames each comprising a pair of cross members for opening and closing in scissors fashion, said cross members each having upper ends, said intermediate frames being spaced apart in a front and rear direction in respect to said chair and having their lower ends rigidly secured to the respective generally horizontal members of said side frames, a seat rail for each pair of said upper ends of said cross members which are located at opposite sides of said chair, said rails having holes for the reception of said upper ends of said cross members, and screws between said upper ends of said cross members and rails, whereby said rails are removably secured between said upper ends of said cross members, a flexible seat member mounted between said seat rails, said side frames being movable toward and away from one another between operative seating and collapsed, storage positions, during which said lower members of said side frames oscillate along with said cross frames and relative to said legs.

10. A folding chair comprising, a pair of vertically disposed and parallel side frames, each side frame comprising, a generally vertical front leg and rear leg, an arm member rigidly secured between said front and rear legs, and a lower, floor engaging, generally horizontal member, a pivotal connection between said lower member and each of said legs of said side frame, said pivotal connection including a screw eye engaged in said legs and having an eye portion extending downwardly therefrom, a transverse slot in said lower horizontal member for the reception of said eye portion and a pin-like member extending into said lower member and engaging said eye portion to form a pivot joint between said leg and said lower member, said chair also having a pair of intermediate frames, said intermediate frames each comprising a pair of cross members pivotally connected together intermediate their length for opening and closing in scissors fashion, said cross members each having upper ends, said intermediate frames being spaced apart in a front and rear direction in respect to said chair and having their lower ends rigidly secured to the respective generally horizontal members of said side frame, a seat rail for each pair of said upper ends of said cross members which are located at opposite sides of said chair, said rails having holes for the reception of said upper ends of said cross members, and screws between said upper ends of said cross members and rails, whereby said rails are removably secured between said upper ends of said cross members, a flexible seat member having loops along each side for being slipped around said seat rails, a back panel secured between said side frames, and stop means between said side frames and said intermediate frames for supporting said seat rails when said chair is in an operative position, said side frames being movable toward and away from one another between operative seating and a collapsed, storage position, whereby said lower members of said side frames oscillate along with said cross frames and relative to said legs when said chair is moved between said storage and seating positions.

11. A folding chair comprising, a pair of generally vertically disposed and parallel side frames, each side frame comprising, a generally vertical front leg and rear leg, an arm member rigidly secured between said front and rear legs, and a lower, floor engaging, generally horizontal member to thereby define a generally rectangular side frame; a pivotal connection between said lower member and each of said legs of said side frame, said pivotal connection including a screw eye engaged in said legs and having an eye portion extending downwardly therefrom, a transverse slot in said lower horizontal member for the reception of said eye portion and a pin-like member extending into said lower member and engaging said eye portion to form a pivot joint between said leg and said lower member, said chair also having a pair of intermediate frames extending transversely between said side frames, said intermediate frames each comprising a pair of crossed members pivotally connected together intermediate their length for opening and closing in scissors fashion, said cross members each having upper ends, said intermediate frames also being spaced apart in a front and rear direction of said chair and having their lower ends rigidly secured to the respective generally horizontal members of said side frames, a seat rail for each pair of said upper ends of said cross members which are located at opposite sides of said chair, said rails having holes for the reception of said upper ends of said cross members, and screws between said upper ends of said cross members and rails, whereby said rails are removably secured between said upper ends of said cross members, a flexible seat member having a loop along each side for being slipped over said seat rails to form a seat therebetween, a flexible back panel secured between said side frames, and stop means between said side frames and said intermediate frames for supporting said seat rails when said chair is in an operative position, said side frames being movable toward and away from one another between operative seating and collapsed, storage positions, whereby said lower members of said side frames oscillate along with said cross frames and relative to said legs when said chair is moved between said storage and seating positions.

12. A folding chair comprising, a pair of generally parallel side frames, each side frame comprising: a front leg and a rear leg, a generally horizontal arm member rigidly secured between said front and rear legs, and a lower, floor engaging, generally horizontal member, a pivotal connection between said lower member and each of said legs of said side frame; said pivotal connection including a screw eye engaged in said legs and having an eye portion extending downwardly therefrom, a transverse slot in said lower horizontal member for the reception of said eye portion and a pin-like member extending into said lower member and engaging said eye portion to form a pivot joint between said leg and said lower member; said chair also having a pair of intermediate frames, each comprising a pair of crossed members pivotally connected together for opening and closing in scissors fashion, said cross members each having upper ends, said intermediate frames being arranged transversely and also spaced apart in a front and rear direction of said chair and having their lower ends rigidly secured to the respective generally horizontal members of said side frames, a seat rail for each pair of said upper ends of said cross members which are located at opposite sides of said chair, said rails having holes for the reception of said upper ends of said cross members, and screws between said upper ends of said cross members and rails, whereby said rails are removably secured between said upper ends of said cross members, said side frames being movable toward and away from one another between operative seating and collapsed, storage positions, during which movement said lower members of said side frames oscillate along with said cross frames and relative to said legs.

13. A folding chair comprising, a pair or parallel side frames, each side frame comprising, a front leg and rear leg, an arm member fixed between said front and rear legs, and a lower, floor engaging, generally horizontal member, said chair also having a pair of intermediate frames, said intermediate frames each comprising a pair of cross members for opening and closing in scissors fashion, said intermediate frames being spaced apart in a front and rear direction in respect to said chair and having their lower ends mounted to the respective generally horizontal members of said side frames, said cross members each having upper ends, a steel rod pivotally connected to and between at least one of said vertical legs and at least one of said cross members, a back rest comprising a panel pivoted about a horizontal axis to and between said arms, means forming a pivotal connection between said side frames and the lower end of said intermediate frames, a seat rail having holes for the reception of said upper ends of said cross members, and screws between said upper ends of said cross members and said rails, whereby said rails are removably but rigidly secured between the upper ends of said cross members, a flexible seat member mounted between said seat rails, said flexible seat member has a loop along each of its sides for being slipped over or removed from said seat rails when the latter are removed from said cross members, said side frames being movable toward and away from one another between operative seating and collapsed, storage positions, during which said lower members of said side frames move along with said cross members and toward and away from one another.

14. The chair set forth in claim 13 further characterized in that said steel rod has a generally right angle end at each of its ends for insertion in said vertical leg and said cross member to form said pivotal connection therebetween.

15. A folding chair comprising, a pair of generally vertically disposed and parallel side frames, each side frame comprising, a generally vertical front leg and rear leg, an arm member rigidly secured between said front and rear legs, and a lower, floor engaging, generally horizontal member to thereby define a generally rectangular side frame; a pivotal connection between said lower member and each of said legs of said side frame, said pivotal connection including a screw eye engaged in said legs and having an eye portion extending downwardly therefrom, a transverse slot in said lower horizontal member for the reception of said eye portion and a pin-like member extending into said lower member and engaging said eye portion to form a pivot joint between said leg and said lower member, said chair also having a pair of intermediate frames extending transversely between said side frames, said intermediate frames each comprising a pair of crossed members pivotally connected together intermediate their length for opening and closing in scissors fashion, said intermediate frames also being spaced apart in a front and rear direction of said chair and having their lower ends rigidly secured to the respective generally horizontal members of said side frames, a seat rail rigidly but removably secured between the upper ends of said cross frames, means for removably securing said seat rails to said upper ends, a flexible seat member having a loop along each side for being slipped over said seat rails to form a seat therebetween, a flexible back panel secured between said side frames, said panel having a pivotal connection about a horizontal axis to said side frames whereby said panel can be pivoted about said axis for adjustment relative to said side frames, and stop means including a steel rod pivotally connected between said side frames and said intermediate frames for supporting said seat rails on said rods when said chair is in an operative position, said side frames being movable toward and away from one another between operative seating and collapsed, storage positions, whereby said lower members of said side frames oscillate along with said cross frames and relative to said legs when said chair is moved between said storage and seating positions.

16. The chair set forth in claim 15 further characterized in that said steel rod has a generally right angle end at each of its ends for insertion in said vertical leg and said cross member to form said pivotal connection therebetween.

* * * * *